US008829885B2

(12) United States Patent
Otsuka et al.

(10) Patent No.: US 8,829,885 B2
(45) Date of Patent: Sep. 9, 2014

(54) VOLTAGE REFERENCE CIRCUIT

(71) Applicant: Seiko Instruments Inc., Chiba (JP)

(72) Inventors: Nao Otsuka, Chiba (JP); Kosuke Takada, Chiba (JP)

(73) Assignee: Seiko Instrumentals Inc., Chiba (JP)

( * ) Notice: Subject to any disclaimer, the term of this patent is extended or adjusted under 35 U.S.C. 154(b) by 0 days.

(21) Appl. No.: 13/784,139

(22) Filed: Mar. 4, 2013

(65) Prior Publication Data

US 2013/0249525 A1 Sep. 26, 2013

(30) Foreign Application Priority Data

Mar. 22, 2012 (JP) ..... 2012-065977

(51) Int. Cl.
*G05F 3/16* (2006.01)
*G05F 1/56* (2006.01)

(52) U.S. Cl.
USPC ..... 323/316; 363/73

(58) Field of Classification Search
USPC ..... 323/312–317, 538–543; 363/73
See application file for complete search history.

(56) References Cited

U.S. PATENT DOCUMENTS

| | | | | |
|---|---|---|---|---|
| 7,268,529 | B2 * | 9/2007 | Mochizuki et al. | 323/316 |
| 7,692,456 | B2 * | 4/2010 | Hanazawa et al. | 327/108 |
| 7,994,848 | B2 * | 8/2011 | Kothandaraman et al. | 327/539 |
| 8,106,707 | B2 | 1/2012 | Katyal et al. | |
| 8,536,854 | B2 * | 9/2013 | Melanson et al. | 323/316 |

OTHER PUBLICATIONS

Ge, Guang et al., "A Single-Trim CMOS Bandgap Reference with a 3σInaccuracy of ±0.15% from –40° C. to 125° C.," 2010 IEEE International Solid-State Circuits Conference, ISSCC 2010, Session 4, Analog Techniques, 4.3, pp. 3 pages.

* cited by examiner

*Primary Examiner* — Jessica Han
(74) *Attorney, Agent, or Firm* — Brinks Gilson & Lione

(57) ABSTRACT

Provided is a voltage reference circuit which is able to obtain high PSRR without a variation in power-supply voltage and an influence of noise. A voltage reference circuit for performing voltage-current conversion on forward voltages of PN junction elements and on a difference therebetween to generate a voltage so as not to depend on a temperature is constituted by an amplifier for controlling a temperature characteristic of a voltage of an output terminal, a source follower circuit for supplying a power to the amplifier, and a PMOS transistor which is controlled by the amplifier and which controls a current to flow into the PN junction elements.

8 Claims, 3 Drawing Sheets

VOLTAGE REFERENCE CIRCUIT

RELATED APPLICATIONS

This application claims priority under 35 U.S.C. §119 to Japanese Patent Application No. 2012-065977 filed on Mar. 22, 2012, the entire content of which is hereby incorporated by reference.

BACKGROUND OF THE INVENTION

1. Field of the Invention

The present invention relates to a bandgap voltage reference circuit for generating a reference voltage.

2. Description of the Related Art

FIG. 3 illustrates a circuit diagram of a conventional bandgap voltage reference circuit. The conventional bandgap voltage reference circuit is constituted by PMOS transistors 311, 312, and 313, bipolar transistors 301, 302, and 303, resistors 106, 107, 108, 109, 110, 331, and 332, amplifiers 102 and 321, a power supply terminal 101, and a ground terminal 100.

The following describes connection. The amplifier 102 is configured such that an inverting input terminal is connected to a connecting point between an emitter of the bipolar transistor 301 and the resistor 107 and to the resistor 110, a noninverting input terminal is connected to a connecting point between the resistor 108 and the resistor 106 and to the resistor 109, and an output is connected to a gate of the PMOS transistor 311. Another end of the resistor 107 is connected to the resistor 332 and another end of the resistor 108. The bipolar transistor 301 is configured such that a base and a collector are connected to the ground terminal 100. The bipolar transistor 302 is configured such that an emitter is connected to another end of the resistor 106 and a base and a collector are connected to the ground terminal 100. The bipolar transistor 303 is configured such that an emitter is connected to another end of the resistor 109 and another end of the resistor 110 and a base and a collector are connected to the ground terminal 100. The PMOS transistor 311 is configured such that a drain is connected to another end of the resistor 332 and an inverting input terminal of the amplifier 321, and a source is connected to the power supply terminal 101. The amplifier 321 is configured such that a noninverting input terminal is connected to a drain of the PMOS transistor 313 and the resistor 331, and an output is connected to a gate of the PMOS transistor 312 and a gate of the PMOS transistor 313. The PMOS transistor 312 is configured such that a drain is connected to an emitter of the bipolar transistor 303, and a source is connected to the power supply terminal 101. A source terminal of the PMOS transistor 313 is connected to the power supply terminal 101. Another end of the resistor 331 is connected to the ground terminal 100.

[Non Patent Document 1] ISSCC 2010/SESSION 4/ANALOG TECHNIQUES/4.3 (FIG. 4.3.3)

SUMMARY OF THE INVENTION

The present invention provides a voltage reference circuit which is able to obtain high PSRR without a variation in a power-supply voltage and an influence of noise as compared with a conventional voltage reference circuit.

A voltage reference circuit of the present invention is a voltage reference circuit for performing voltage-current conversion on forward voltages of PN junction elements and on a difference therebetween so as to generate a voltage and includes an amplifier for controlling a temperature characteristic of a voltage of an output terminal, a source follower circuit for supplying a power to the amplifier, and a PMOS transistor for controlling a current to flow into the PN junction elements.

According to the present invention, it is possible to reduce a variation in a power-supply voltage and an influence of noise and to improve PSRR of an output voltage.

DETAILED DESCRIPTION OF THE PREFERRED EMBODIMENTS

Embodiments of the present invention will be described below with reference to drawings.

First Embodiment

Figure 1:
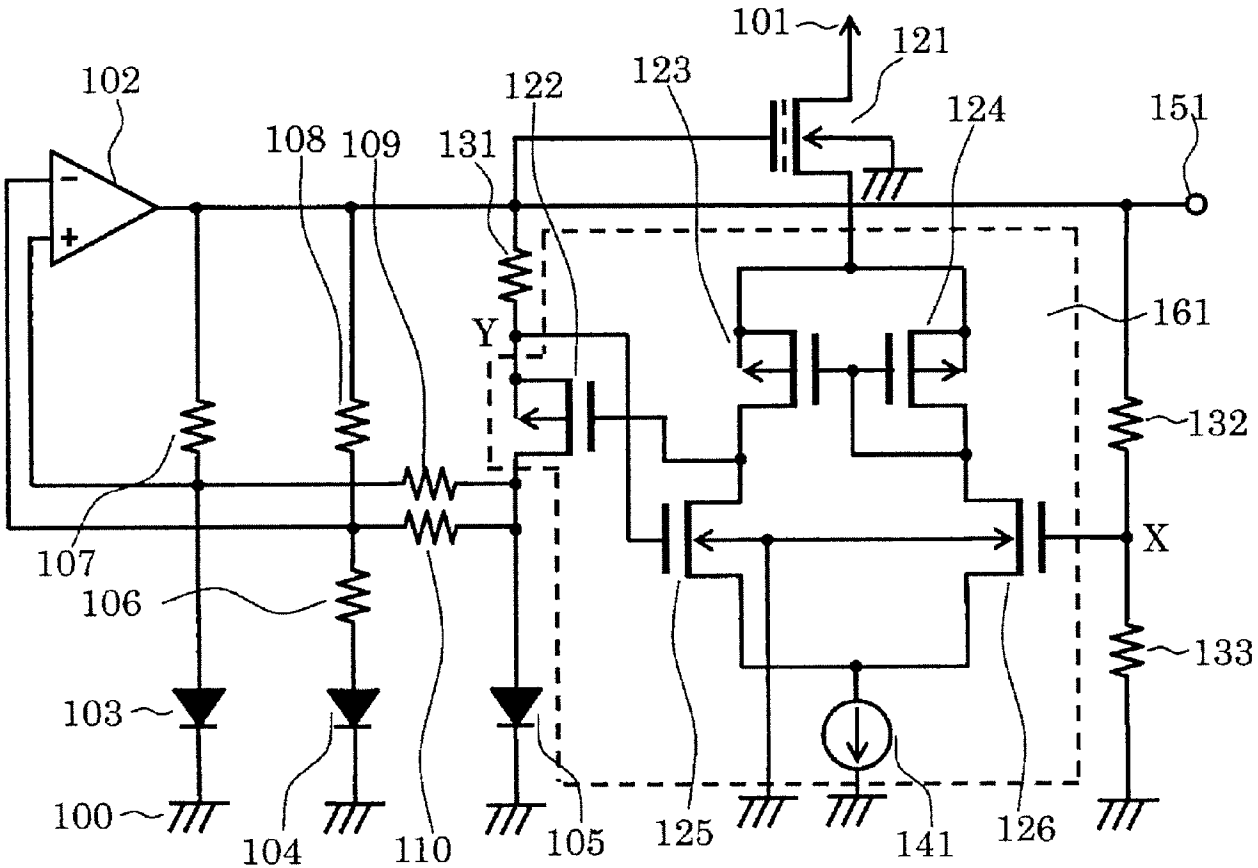
FIG. 1 is a circuit diagram illustrating a voltage reference circuit according to a first embodiment.

FIG. 1 is a circuit diagram of a voltage reference circuit according to a first embodiment.

The voltage reference circuit of the first embodiment includes PMOS transistors 122, 123, and 124, NMOS transistors 125 and 126, an Nch depression transistor 121, resistors 106, 107, 108, 109, 110, 131, 132, and 133, PN junction elements 103, 104, and 105, an amplifier 102, a constant current circuit 141, a ground terminal 100, a power supply terminal 101, and an output terminal 151. The PMOS transistors 122, 123, and 124, the NMOS transistors 125 and 126, and the constant current circuit 141 constitute a voltage-current converting circuit 161, and the PMOS transistor 122 works as an output transistor of the voltage-current converting circuit 161.

The following describes connection. The amplifier 102 is configured such that a noninverting input terminal is connected to an anode of the PN junction element 103, the resistor 107, and the resistor 109, an inverting input terminal is connected to a connecting point between the resistor 108 and the resistor 106 and to the resistor 110, and an output is connected to another end of the resistor 107, another end of the resistor 108, and the output terminal 151. A cathode of the PN junction element 103 is connected to the ground terminal 100. The PN junction element 104 is configured such that an anode is connected to another end of the resistor 106 and a cathode is connected to the ground terminal 100. The PN junction element 105 is configured such that an anode is connected to another end of the resistor 109, another end of the resistor 110, and a drain of the PMOS transistor 122, and a cathode is connected to the ground terminal 100. The PMOS transistor 122 is configured such that a gate is connected to a drain of the NMOS transistor 125, a source is connected to the resistor 131, and a back gate is connected to the source. The NMOS transistor 125 is configured such that a gate is connected to the source of the PMOS transistor 122, a source is connected to the constant current circuit 141, and a back gate is connected to the ground terminal 100. Another end of the constant current circuit 141 is connected to the ground terminal 100. The NMOS transistor 126 is configured such that a gate is connected to a connecting point between the resistor 132 and the resistor 133, a drain is connected to a gate and a drain of the PMOS transistor 124, a source is connected to the source of the NMOS transistor 125, and a back gate is connected to the ground terminal 100. Another end of the resistor 133 is connected to the ground terminal 100, and another end of the resistor 132 is connected to the output terminal 151. The PMOS transistor 123 is configured such that a gate is connected to the gate of the PMOS transistor 124, a drain is connected to the drain of the NMOS transistor 125, a source is connected to a source of the Nch depression transistor 121, and a back gate is connected to the source. The PMOS transistor 124 is configured such that a source is connected to the source of the PMOS transistor 123, and a back gate is connected to the source. The Nch depression transistor 121 is configured such that a gate is connected to the output terminal 151 and another end of the resistor 131, a drain is connected to the power supply terminal 101, and a back gate is connected to the ground terminal 100.

The following describes an operation of the voltage reference circuit of the present embodiment. The PN junction elements 103 and 104 are configured with an appropriate area ratio (e.g., one to four), so as to output a voltage VBG to the output terminal 151 from an output of the amplifier 102. A connecting point between the resistor 132 and the resistor 133 is assumed as a node X, and a connecting point between the resistor 131 and the source of the PMOS transistor 122 is assumed as a node Y. The voltage-current converting circuit 161 controls the PMOS transistor 122 so that a voltage of the node X and a voltage of the node Y which are obtained by dividing the output voltage VBG according to resistances are equal to each other.

The voltage VBG is obtained by adding voltages at both ends of the resistor 107 to an anode voltage of the PN junction element 103. The anode voltage of the PN junction element 103 has a component which linearly decreases along with an increase in temperature and a component which nonlinearly decreases along with the increase in temperature. On the other hand, a current flowing in the resistor 107 linearly increases along with the increase in temperature. As a result, a temperature characteristic of the voltage VBG has nonlinearity due to the anode voltage of the PN junction element 103. The PN junction element 105 is a PN junction element which is added so that the voltage VBG does not depend on the temperature. A current having a temperature characteristic different from that of the PN junction element 103 flows into the PN junction element 105. In this case, a nonlinear component of the temperature characteristic of an anode voltage of the PN junction element 105 has a coefficient different from that of the nonlinear component of the anode voltage of the PN junction element 103. On that account, a potential difference nonlinear to the temperature is caused between the anode of the PN junction element 103 and the anode of the PN junction element 105. A current caused by the potential difference is supplied from the amplifier 102 and flows into the resistor 107 and the resistor 110. Since the current having a nonlinear temperature characteristic flows in the resistor 107, voltages having a nonlinear temperature characteristic are generated at both ends of the resistor 107. A magnitude of these nonlinear components can be adjusted by changing a resistance value of the resistor 110. The adjustment causes the nonlinear temperature characteristic of the voltages at both ends of the resistor 107 in a direction to cancel the nonlinear temperature characteristic of the anode voltage of the PN junction element 103, thereby allowing the voltage VBG to be a constant voltage which does not depend on the temperature.

The Nch depression transistor 121 forms a source follower. Since its gate is connected to the output terminal, a source voltage becomes VBG+|Vtnd| where Vtnd denotes a threshold value of the Nch depression transistor 121, and thus, it is possible to output a voltage sufficient to drive the voltage-current converting circuit 161. The voltage-current converting circuit 161 is driven by using this voltage, and thus is able to be operated without a variation due to the power supply and an influence of power-supply noise.

Note that as the PN junction element, a diode or a bipolar transistor which is saturated and connected may be used. Further, the source follower may be formed of other configurations. The current source 141 may be a resistor.

As has been described above, according to the voltage reference circuit of the first embodiment, since the source follower of the Nch depression transistor of which the gate is connected to the output terminal is used for a power supply of the amplifier, it is possible to reduce a variation in a power-supply voltage and an influence of noise and to improve PSRR of an output voltage.

Second Embodiment

Figure 2:
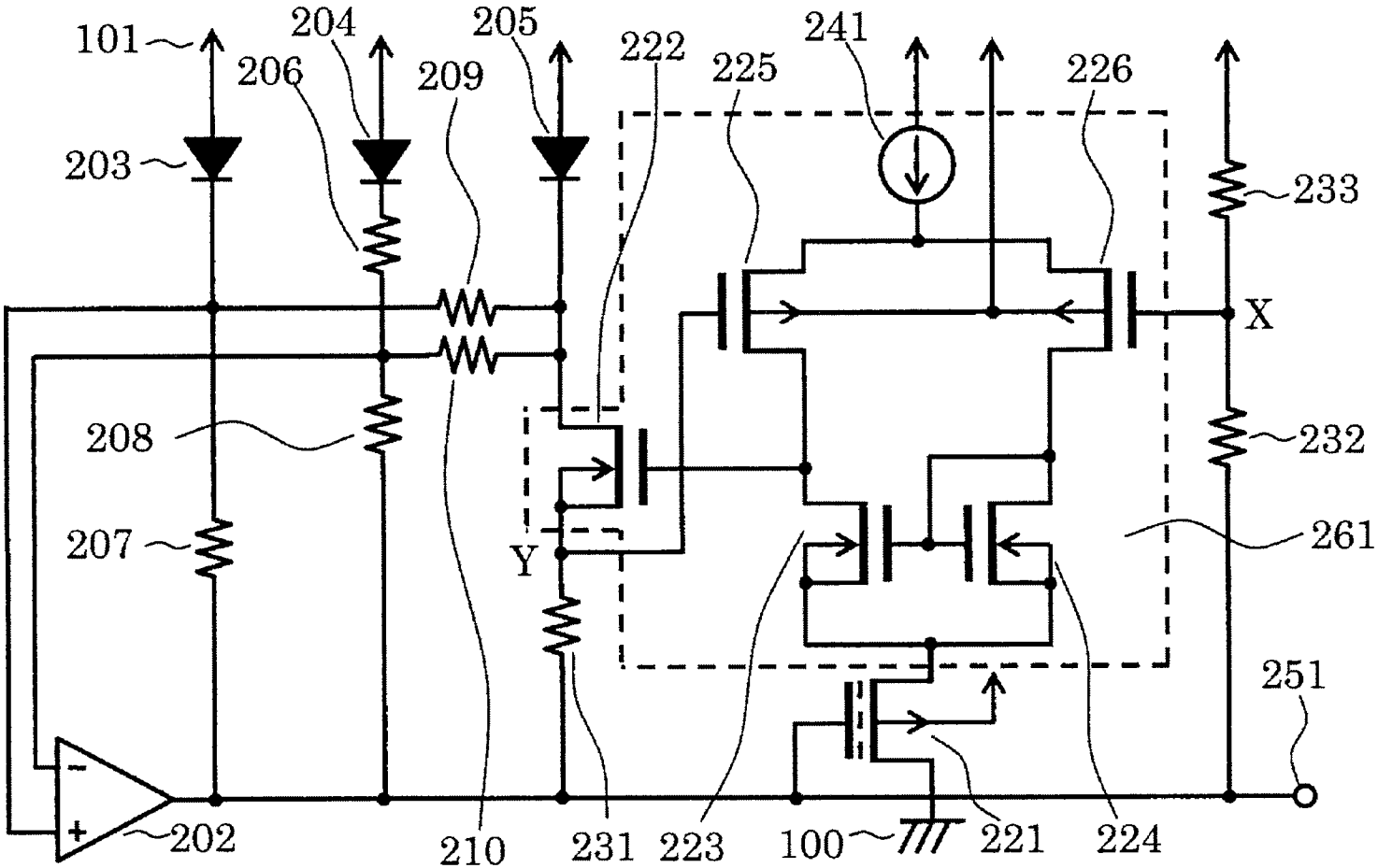
FIG. 2 is a circuit diagram illustrating a voltage reference circuit according to a second embodiment.
Figure 3:
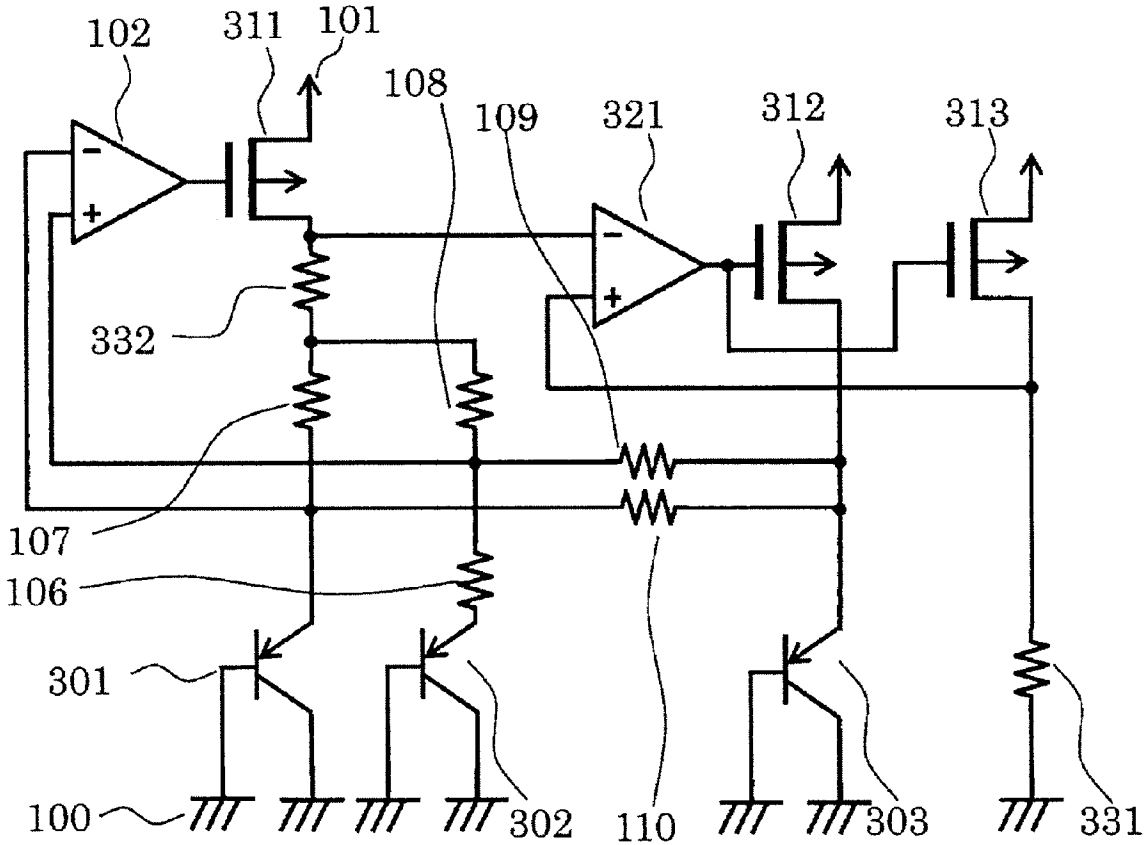
FIG. 3 PRIOR ART
FIG. 3 is a circuit diagram illustrating a conventional voltage reference circuit.

FIG. 2 is a circuit diagram of a voltage reference circuit according to a second embodiment.

The voltage reference circuit of the second embodiment includes NMOS transistors 222, 223, and 224, PMOS transistors 225 and 226, a Pch depression transistor 221, resistors 206, 207, 208, 209, 210, 231, 232, and 233, PN junction elements 203, 204, and 205, an amplifier 202, a constant current circuit 241, a ground terminal 100, a power supply terminal 101, and an output terminal 251. The NMOS transistors 222, 223, and 224, the PMOS transistors 225 and 226, and the constant current circuit 241 constitute a voltage-current converting circuit 261, and the NMOS transistor 222 works as an output transistor of the voltage-current converting circuit 261.

The following describes connection. The amplifier 202 is configured such that a noninverting input terminal is connected to a cathode of the PN junction element 203, the resistor 207, and the resistor 209, an inverting input terminal is connected to a connecting point between the resistor 208 and the resistor 206 and to the resistor 210, and an output is connected to another end of the resistor 207, another end of the resistor 208, and the output terminal 251. An anode of the PN junction element 203 is connected to the power supply terminal 101. The PN junction element 204 is configured such that a cathode is connected to another end of the resistor 206 and an anode is connected to the power supply terminal 101. The PN junction element 205 is configured such that a cathode is connected to another end of the resistor 209, another end of the resistor 210, and a drain of the NMOS transistor 222, and an anode is connected to the power supply terminal 101. The NMOS transistor 222 is configured such that a gate is connected to a drain of the PMOS transistor 225, a source is connected to the resistor 231, and a back gate is connected to the source. The PMOS transistor 225 is configured such that a gate is connected to the source of the NMOS transistor 222, a source is connected to the constant current circuit 241, and a back gate is connected to the power supply terminal 101. Another end of the constant current circuit 241 is connected to the power supply terminal 101. The PMOS transistor 226 is configured such that a gate is connected to a connecting point between the resistor 232 and the resistor 233, a drain is connected to a gate and a drain of the NMOS transistor 224, a source is connected to a source of the PMOS transistor 225, and a back gate is connected to the power supply terminal 101. Another end of the resistor 233 is connected to the power supply terminal 101, and another end of the resistor 232 is connected to the output terminal 251. The NMOS transistor 223 is configured such that a gate is connected to the gate of the NMOS transistor 224, a drain is connected to the drain of the PMOS transistor 225, a source is connected to a source of the Pch depression transistor 221, and a back gate is connected to the source. The NMOS transistor 224 is configured such that a source is connected to the source of the NMOS transistor 223, and a back gate is connected to the source. The Pch depression transistor 221 is configured such that a gate is connected to the output terminal 251 and another end of the resistor 231, a drain is connected to the ground terminal 100, and a back gate is connected to the power supply terminal 101.

The following describes an operation of the voltage reference circuit of the present embodiment. The PN junction elements 203 and 204 are configured with an appropriate area ratio (e.g., one to four), so as to output a voltage VBG to the output terminal 251 from an output of the amplifier 202. A connecting point between the resistor 232 and the resistor 233 is assumed as a node X, and a connecting point between the resistor 231 and the source of the NMOS transistor 222 is assumed as a node Y. The voltage-current converting circuit 261 controls the NMOS transistor 222 so that a voltage of the node X and a voltage of the node Y which are obtained by dividing the output voltage VBG according to resistances are equal to each other.

The voltage VBG is obtained by adding voltages at both ends of the resistor 207 to a cathode voltage of the PN junction element 203. The cathode voltage of the PN junction element 203 has a component which linearly increases along with an increase in temperature and a component which nonlinearly increases along with the increase in temperature. On the other hand, a current flowing into the resistor 207 linearly increases along with the increase in temperature. As a result, a temperature characteristic of the voltage VBG has nonlinearity due to the cathode voltage of the PN junction element 203. The PN junction element 205 is a PN junction element which is added so that the voltage VBG does not depend on the temperature. A current having a temperature characteristic different from that of the PN junction element 203 flows into the PN junction element 205. In this case, a nonlinear component of the temperature characteristic of a cathode voltage of the PN junction element 205 has a coefficient different from that of the nonlinear component of the cathode voltage of the PN junction element 203. On that account, a potential difference which is nonlinear to the temperature is caused between the cathode of the PN junction element 203 and the cathode of the PN junction element 205. A current caused by the potential difference is supplied from the amplifier 202 and flows into the resistor 207 and the resistor 210. Since the current having a nonlinear temperature characteristic flows in the resistor 207, voltages having a nonlinear temperature characteristic are generated at both ends of the resistor 207. A magnitude of these nonlinear components can be adjusted by changing a resistance value of the resistor 210. The adjustment causes the nonlinear temperature characteristic of the voltages at both ends of the resistor 207 in a direction to cancel the nonlinear temperature characteristic of the cathode voltage of the PN junction element 203, thereby allowing the voltage VBG to be a constant voltage which does not depend on the temperature.

The Pch depression transistor 221 forms a source follower. Since its gate is connected to the output terminal, a source voltage becomes VBG+|Vtpd| where Vtpd denotes a threshold value of the Pch depression transistor 221, and thus, it is possible to output a voltage sufficient to drive the voltage-current converting circuit 261. The voltage-current converting circuit 261 is driven by using this voltage, and thus is able to be operated without a variation due to the power supply and an influence of power-supply noise.

Note that as the PN junction element, a diode or a bipolar transistor which is saturated and connected may be used. Further, the source follower may be formed of other configurations. The current source 241 may be a resistor.

As has been described above, according to the voltage reference circuit of the second embodiment, since the source follower of the Pch depression transistor of which the gate is connected to the output terminal is used for a power supply of the amplifier, it is possible to reduce a variation in a power-supply voltage and an influence of noise and to improve PSRR of an output voltage.

What is claimed is:

1. A voltage reference circuit for performing voltage-current conversion on a difference between forward voltages of a plurality of PN junction elements to generate a less temperature-dependent voltage, the voltage reference circuit comprising:

a voltage-current converting circuit for controlling a current to flow into the plurality of PN junction elements; and a source follower circuit for supplying a power to the voltage-current converting circuit.

2. The voltage reference circuit according to claim 1, wherein:

the source follower circuit is constituted by a depression-type MOS transistor in which a gate is connected to an output terminal of the voltage reference circuit and a source is connected to a power supply terminal of the voltage-current converting circuit.

3. The voltage reference circuit according to claim 2, wherein:

the voltage-current converting circuit includes an amplifier and an output transistor, and the output transistor is configured such that a back gate and a source are connected to the output terminal of the voltage reference circuit via a resistor.

4. A voltage reference circuit comprising:

a plurality of PN junction elements configured to output an output voltage on an output terminal;

an amplifier coupled with the PN junction elements and configured to compensate for non-linear temperature characteristics of the output voltage on the output terminal;

a voltage-current converting circuit configured to generate a current flow into at least one of the PN junction elements to control the amplifier; and a source follower circuit configured to generate a driving voltage to drive the voltage-current converting circuit that compensates for variation in a supplied power.

5. The voltage reference circuit of claim 4, wherein the plurality of PN junction elements comprise a first PN junction element and a second PN junction element where a first current flows through the first PN junction element and a second current flows through the second PN junction element, a temperature characteristic of the second current being different than the first current.

6. The voltage reference circuit of claim 4, wherein the amplifier supplies a current used to cancel a non-linear characteristic included in at least one of the PN junction elements.

7. The voltage reference circuit of claim 6, wherein the current cancels an anode voltage non-linear characteristic of at least one PN junction element from among the plurality of PN junction elements.

8. The voltage reference circuit of claim 6, wherein the current cancels a cathode voltage non-linear characteristic of at least one PN junction element from among the plurality of PN junction elements.

* * * * *

UNITED STATES PATENT AND TRADEMARK OFFICE

CERTIFICATE OF CORRECTION

PATENT NO. : 8,829,885 B2
APPLICATION NO. : 13/784139
DATED : September 9, 2014
INVENTOR(S) : Nao Otsuka et al.

It is certified that error appears in the above-identified patent and that said Letters Patent is hereby corrected as shown below:

On the Title Page At Item (73) Assignee:

Delete "Seiko Instrumentals, Inc." and insert --Seiko Instruments, Inc.--

Signed and Sealed this
Seventh Day of April, 2015

Michelle K. Lee

Michelle K. Lee
*Director of the United States Patent and Trademark Office*